US012397947B2

(12) United States Patent
Soria et al.

(10) Patent No.: US 12,397,947 B2
(45) Date of Patent: Aug. 26, 2025

(54) GASSING RAIL AND A GASSING RAIL SYSTEM FOR GAS FLUSHING CONTAINERS AND CAPS ON A ROTARY CAPPING MACHINE

(71) Applicant: Excel Packaging Consulting, LLC, Big Rock, IL (US)

(72) Inventors: Francisco J. Soria, Big Rock, IL (US); Koon H. Wong, Deerfield, IL (US)

(73) Assignee: Excel Packaging Consulting, LLC, Big Rock, IL (US)

( * ) Notice: Subject to any disclaimer, the term of this patent is extended or adjusted under 35 U.S.C. 154(b) by 72 days.

(21) Appl. No.: 18/520,903

(22) Filed: Nov. 28, 2023

(65) Prior Publication Data

US 2025/0171179 A1 May 29, 2025

(51) Int. Cl.
*B65B 31/00* (2006.01)

(52) U.S. Cl.
CPC ..... *B65B 31/00* (2013.01)

(58) Field of Classification Search
USPC ..... 53/110
See application file for complete search history.

(56) References Cited

U.S. PATENT DOCUMENTS

2003/0159408 A1* 8/2003 Seebeger ..... B65B 7/2807 53/471

* cited by examiner

*Primary Examiner* — Chinyere J Rushing-Tucker
(74) *Attorney, Agent, or Firm* — IpHorgan Ltd.

(57) ABSTRACT

The present invention provides a gassing rail for gas flushing containers and caps on a rotary capping machine, wherein the gassing rail includes a generally planar body, an upper surface formed on the generally flat planar body, the upper surface having at least one cap gas distribution slot defining a longitudinally extending cap path, the cap gas distribution slot includes an infeed end and an exit end, a lower surface formed on the generally flat planar body, the lower surface having at least one container gas distribution slot defining a longitudinally extending container path, the container gas distribution slot includes an infeed end and an exit end, wherein the cap infeed end is horizontally spaced apart from the container infeed end and the cap path and container path horizontally converge in the direction towards the cap exit end and container exit end. The present invention also provides a gassing rail system for gas flushing containers and caps on a rotary capping machine, the gassing rail system includes the capper gassing rail and at least one curved longitudinally extending side gassing rail having a proximal or infeed end and a distal or discharge end, the side gassing rail extends from the system away and downstream from the generally planar body, the side gassing rail further defines the longitudinally extending cap path, the side gassing rail defines an adjacent cap fastening area.

24 Claims, 10 Drawing Sheets

FIG. 8
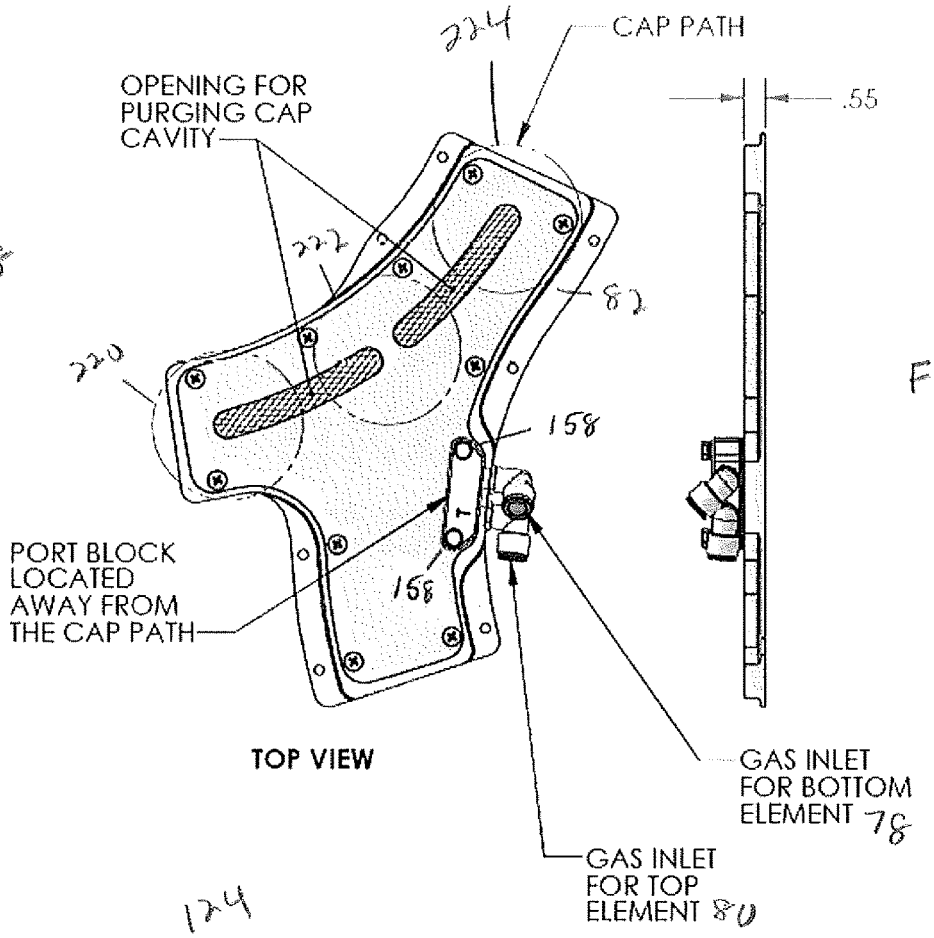
FIG. 9
FIG. 10
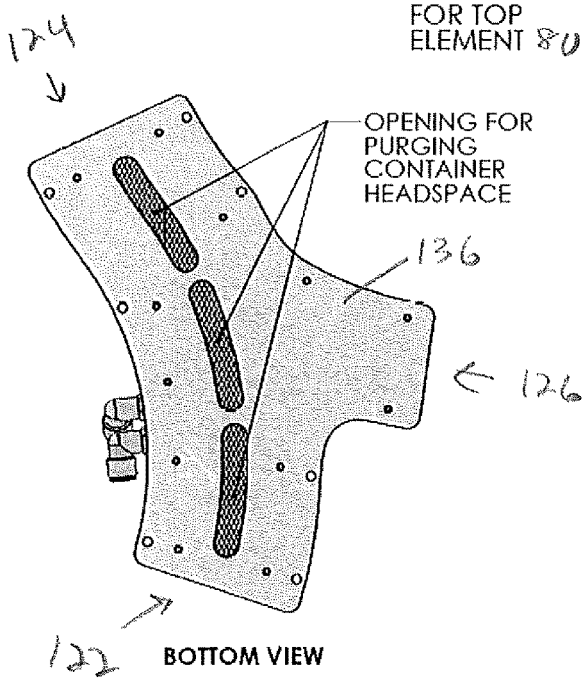

GASSING RAIL AND A GASSING RAIL SYSTEM FOR GAS FLUSHING CONTAINERS AND CAPS ON A ROTARY CAPPING MACHINE

FIELD OF THE INVENTION

The present invention relates to gassing rail assembly for flushing gas during packaging process and, in particular, for a capping machine.

BACKGROUND OF THE INVENTION

The food packaging industry includes systems which provide a transport system to move containers through product fill stations. The transport system then moves the filled containers to capping systems. The capping systems include automatic handling of caps which are secured to the filled container. The caps may be screw-type caps, crimp-type caps or other. The cap may include a foil seal with adhesive or similar sealing mechanism. Capping systems include rotary and single head capping systems. Some applications require that the capping systems run at a high-speed to provide a high-production volume. Throughout the product filling and capping stages, the containers are in constant movement along a transport or conveyer system. The transport system supports the containers and includes means of lateral support and guidance of the container along the transport system. Such guidance may include a longitudinally extending rail for linear movement of the containers. Alternatively, the guidance may include star wheels and guides for non-linear movement, such as through a capping station. The various supporting and guidance systems may be provided at various elevations with respect to the container. In such systems, at the point where the containers filled with product converge with the capping system, the capping system may include an overhead chuck which applies the cap to the moving container and secures the cap to the container via spinning or crimping action, or as appropriate. As will be appreciated, the containers are often embedded in a maze of various high-speed transporting, guiding, and processing stations. Accordingly, additional access to the containers is significantly limited.

The prior art in the food packaging industry also includes gassing rail systems for flushing gas during packaging process. The flushing gas is used to displace an undesirable gas from an open container during the packaging process. The flushing occurs in advance of closing or sealing the container. U.S. Pat. No. 5,682,723 is directed to an apparatus and method for purging air from open containers holding various types of products. Such gassing rail systems generally run along a linear path with the flushing gas system suspended over the open containers.

SUMMARY OF THE INVENTION

In one embodiment, the present invention provides a gassing rail for gas flushing containers and caps on a rotary capping machine, wherein the gassing rail includes a generally planar body, an upper surface formed on the generally flat planar body, the upper surface having at least one cap gas distribution slot defining a longitudinally extending cap path, the cap gas distribution slot includes an infeed end and an exit end, a lower surface formed on the generally flat planar body, the lower surface having at least one container gas distribution slot defining a longitudinally extending container path, the container gas distribution slot includes an infeed end and an exit end, wherein the cap infeed end is horizontally spaced apart from the container infeed end and the cap path and container path horizontally converge in the direction towards the cap exit end and container exit end. In another embodiment, the present invention provides a gassing rail system for gas flushing containers and caps on a rotary capping machine, the gassing rail system includes the capper gassing rail and at least one curved longitudinally extending side gassing rail having a proximal or infeed end and a distal or discharge end, the side gassing rail extends from the system away and downstream from the generally planar body, the side gassing rail further defines the longitudinally extending cap path, the side gassing rail defines an adjacent cap fastening area.

BRIEF DESCRIPTION OF THE DRAWINGS

FIG. 8 is a plan view of the capper gassing rail of FIG. 3.

FIG. 9 is a side view of the capper gassing rail of FIG. 3.

FIG. 10 is a bottom view of the capper gassing rail of FIG. 3.

DETAILED DESCRIPTION OF THE INVENTION

Figure 1:
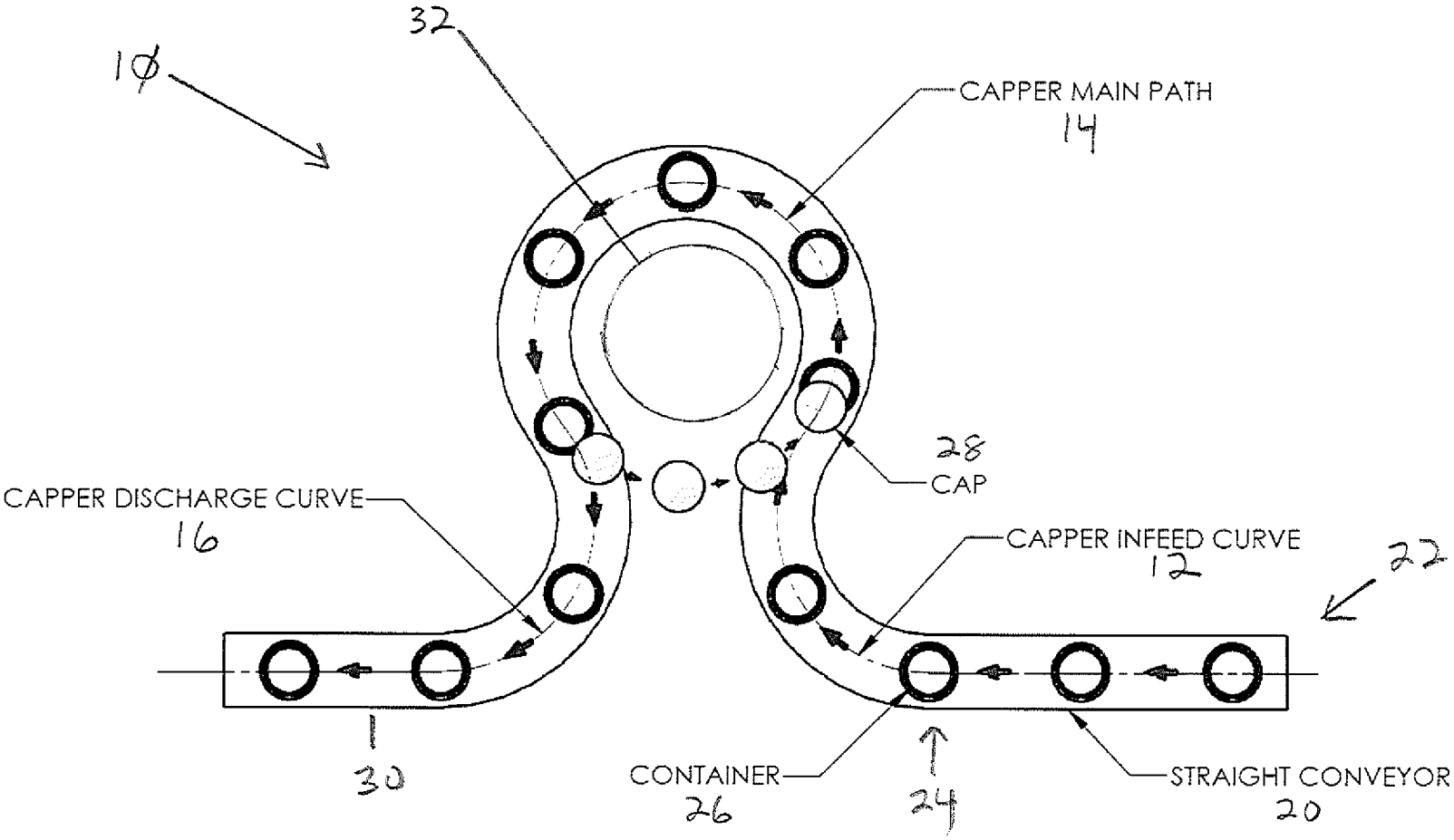
FIG. 1 is a plan diagram representing a rotary capping machine of the prior art.

FIG. 1 is a plan diagram which represents a generic rotary capping machine 10 of the prior art. In general, each machine 10 has three curved paths, an infeed 12, main 14 and discharge 16. FIG. 1 is representative of but one example. Each section of capping machine has an infeed or proximal end and a discharge or distal end. The rotary capping machine of FIG. 1 includes a straight infeed conveyor system 20 which includes an infeed end 22 and a discharge end 24. The straight infeed conveyor system transports containers 26 in the direction towards the capper curved infeed path. The capper curved infeed path represents a transfer system for moving the containers off the straight infeed conveyor system and onto the rotary capping machine. From there, the containers are transported to the capper curved main path which represents a capper curved main transfer system or rotary capping machine, where caps 28 are secured to the container. From there, the containers move to a capper curved discharge path. The capper curved discharge path is a transfer system for moving the containers, which have now been capped, from the rotary capping machine to the straight discharge conveyor system 30. In the generic rotary capping machine of FIG. 1, the path of the containers can be seen to move from the straight conveyor, to the capper infeed curve, through the capper main path, out of the capper main path via the capper discharge curve, and then to the straight discharge conveyor.

The center rotary structure 32 supports the plurality of chucks 34. The chucks receive caps and move them into the capper main path, in a manner which converge with the containers moving along the capper infeed curve as the containers enter the capper main path. With a cap secured in the jaws of a chuck, the chuck converges with the path of a container entering the capper main path. The cap is held just above the container, and is then lowered onto the moving container, and secured to the container. For screw caps, the chuck will rotate the cap onto the threads of the container. For crimp caps, the chucks will apply the appropriate crimping action to the cap after it is placed over the opening of the container. It will be appreciated that the continuous, high speed, movement of the chucks and caps, as they merge in the path of the continuous, high speed, movement of the containers, renders problematic the use of traditional overhead gas flushing of the containers as they move into the capper main path, prior to being capped.

Figure 2:
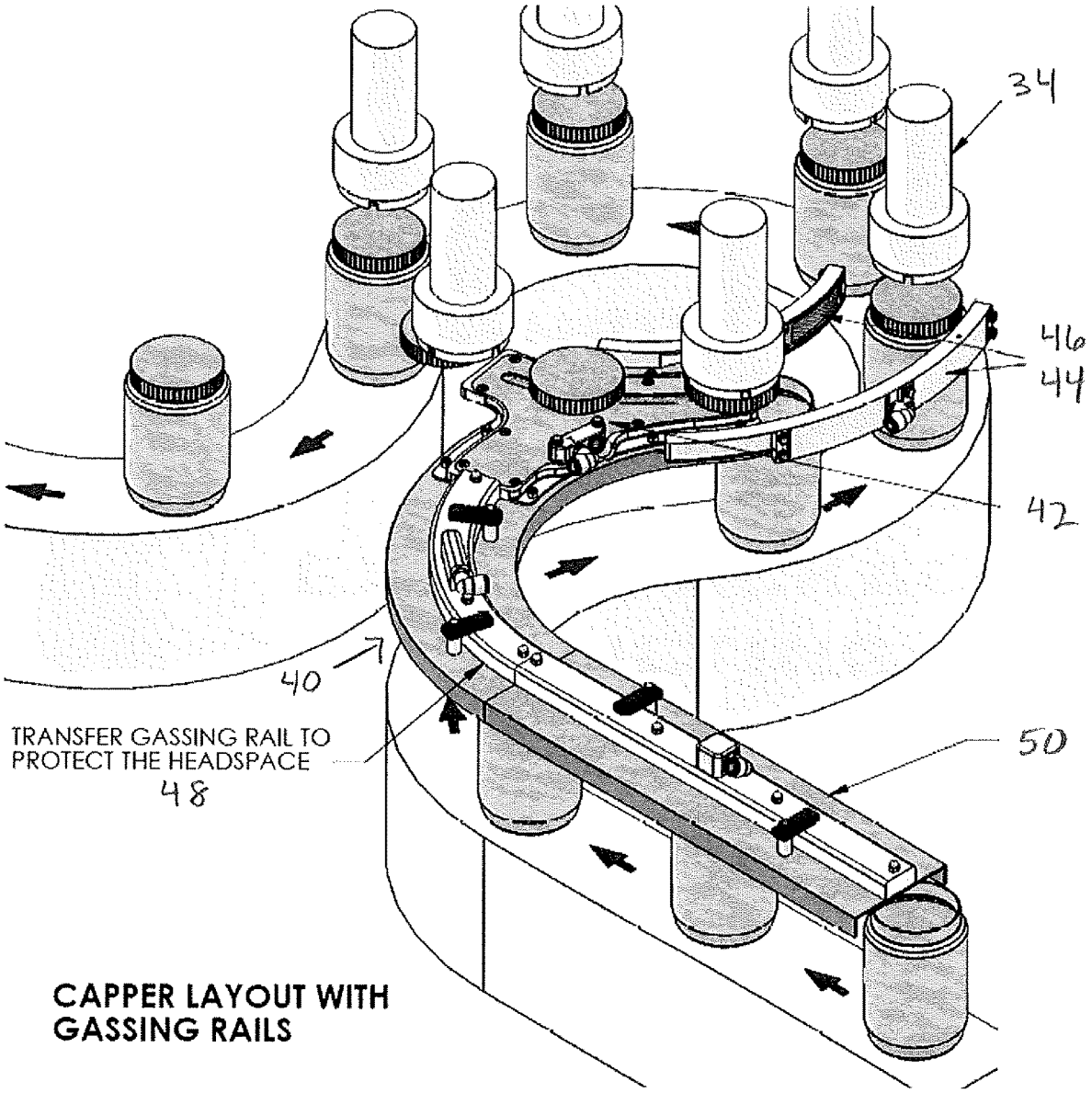
FIG. 2 is a perspective view of the gassing rail system for gas flushing containers and caps, of the present invention, together with a perspective diagram representing a generic prior art rotary capping machine.

FIG. 2 is a perspective view of the gassing rail system 40 for gas flushing containers and caps, of the present invention, together with a perspective diagram representing the generic prior art rotary capping machine 10. The plurality of chucks suspended and operated by the prior art center rotary structure 32 are shown. The chucks are in continuous movement in a manner to coincide with a respective container entering the main path of the rotary capping machine. The gassing rail system 40 of the present invention is shown to include a capper gassing rail 42, two curved longitudinally extending side gassing rails 44, 46, a transfer gassing rail 48, as well as a straight gassing rail 50.

The straight gassing rail purges the container headspace. Thereafter, the curved transition or transfer gassing rail 48 purges the containers during the capper infeed curved path. The capper gassing rail 42 is designed to provide a low profile so that it may be located between respective converging container and cap. The capper gassing rail 42 continues the purging of the opened container. In addition, the capper gassing rail simultaneously purges the cavity of the cap moving over the capper gassing rail and converging vertically with the respective container.

After the container and respective cap are purged and advance past the capper gassing rail, the cap and container converge vertically from a first position having a maximum spaced apart distance to a final position where the cap and container are engaged and sealed. From the first to the final position, the container head space and cap cavity are again exposed. For this reason, the two curved longitudinally extending side gassing rails are provided. The side gassing rails are on either side of the container and cap between the first and final positions, in a cap fastening area, and provide a gas cloud to protect this open space. In some applications, there is not adequate space for the two side gassing rails. In such applications, a single side gassing rail may be provided in the alternative.

Figure 3:
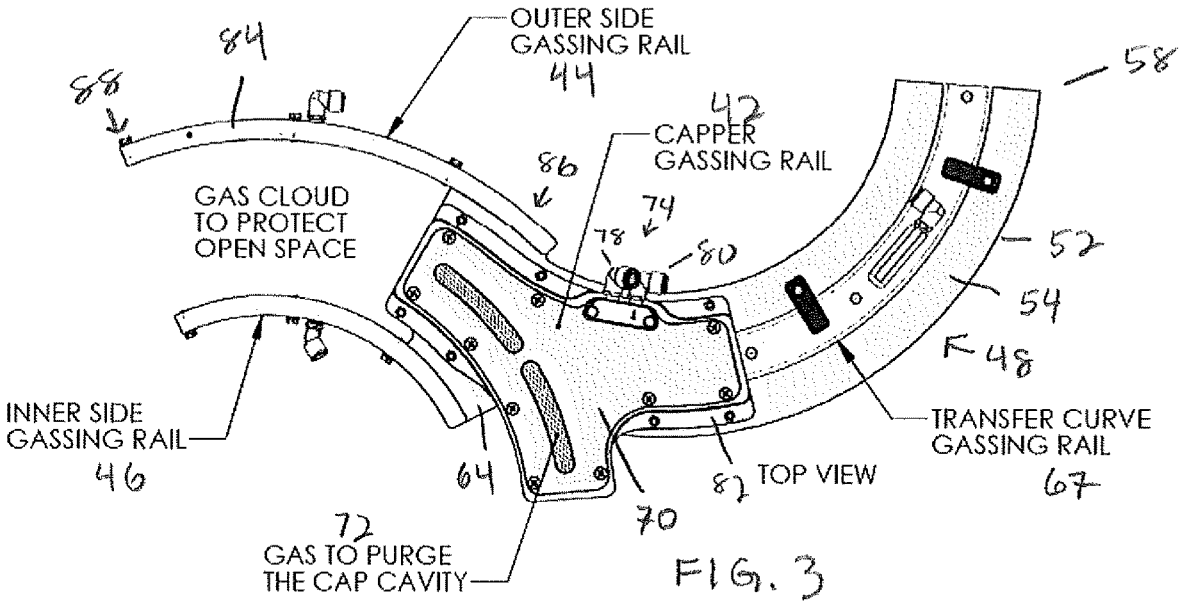
FIG. 3 is a plan view of the gassing rail system of the present invention, including the capper gassing rail, side gassing rail and transfer curve gassing rail system.
Figure 4:
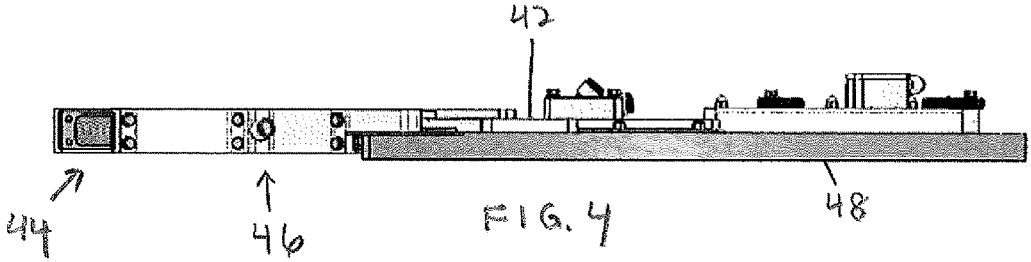
FIG. 4 is a side view of FIG. 3
Figure 5:
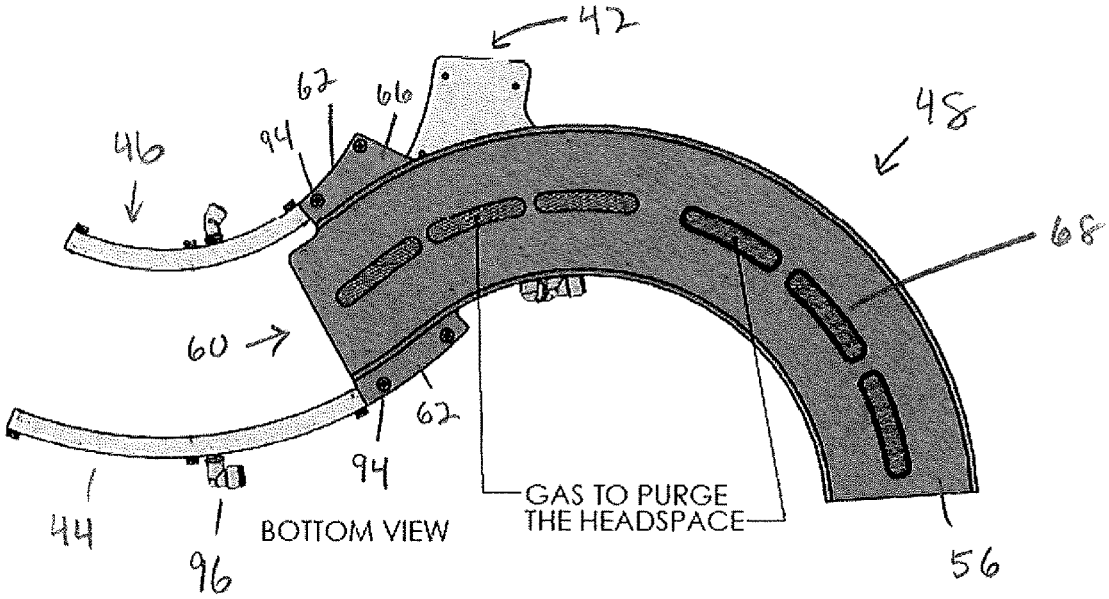
FIG. 5 is a bottom view of FIG. 3.

FIGS. 3-5 disclose the gassing rail system 40 of the present invention, including the capper gassing rail 42, two curved, outer and inner, longitudinally extending side gassing rails 44, 46, and a transition or transfer curve gassing rail system 48. The transfer curve gassing rail system includes a curved transition rail bottom 52 having a top surface 54, a lower surface 56, an infeed end 58 and a discharge end 60. The discharge end includes two flanges 62 extending laterally having a top surface and a bottom surface 66, the flanges may provide a mounting surface for the two curved longitudinally extending side gassing rails. The top surface of the curved transition rail bottom provides a mounting surface for the capper gassing rail and the rail top assembly or transfer gassing rail 67. The lower surface of the curved transition rail bottom includes a plurality of container gas distribution slots 68.

The capper gassing rail includes an upper surface 70 having a plurality of cap gassing distribution slots 72 and a dual port block assembly 74. The dual port block assembly includes a dual port block 76, a container port fitting 78 and a cap port fitting 80. The fittings extend generally horizontally. The capper gassing rail includes a flange 82 for mounting to the curved transition rail bottom.

The two curved longitudinally extending side gassing rails each include a longitudinally extending case 84 having an infeed or proximal end 86 and a discharge or distal end 88. The proximal end includes a notch 90 and provides a lower surface 92 and threaded opening for mounting on the mounting surface of the respective flange with a threaded fastener 94. For some applications, the notch is provide so as to provide an upper surface for mounting on the respective flange. Each side gassing rail includes a port fitting 96 which generally extends horizontally from the side gassing rail. The side view of FIG. 4 shows the low profile of the capper gassing rail and side gassing rails.

Figure 6:
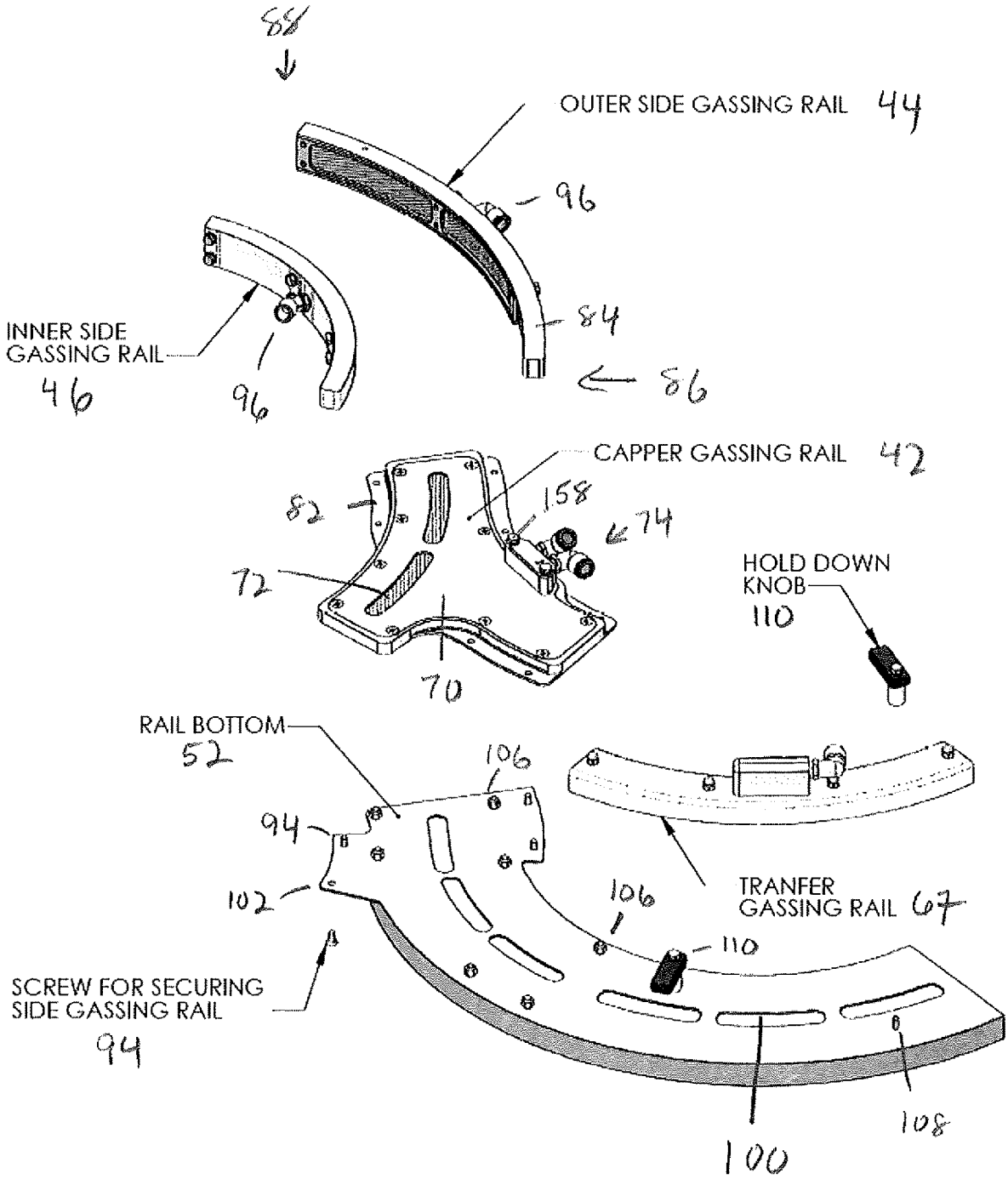
FIG. 6 is an in-part exploded view of the gassing rail system of FIG. 3.

FIG. 6 is an in-part exploded view of the gassing rail system of FIG. 3. The curved transition rail bottom 52 includes a plurality of container gas distribution slots 100, through holes 102 which receive a threaded fastener 94 for securing a side gassing rail, through holes for receiving threaded fastener and nuts 106 to secure the flange of the capper gassing rail to the curved transition rail bottom, threaded fasteners 108 for securing rotating locking arms 110, and the rotating locking arms for securing the transfer gassing rail 67 to the curved transition rail bottom.

Figure 7:
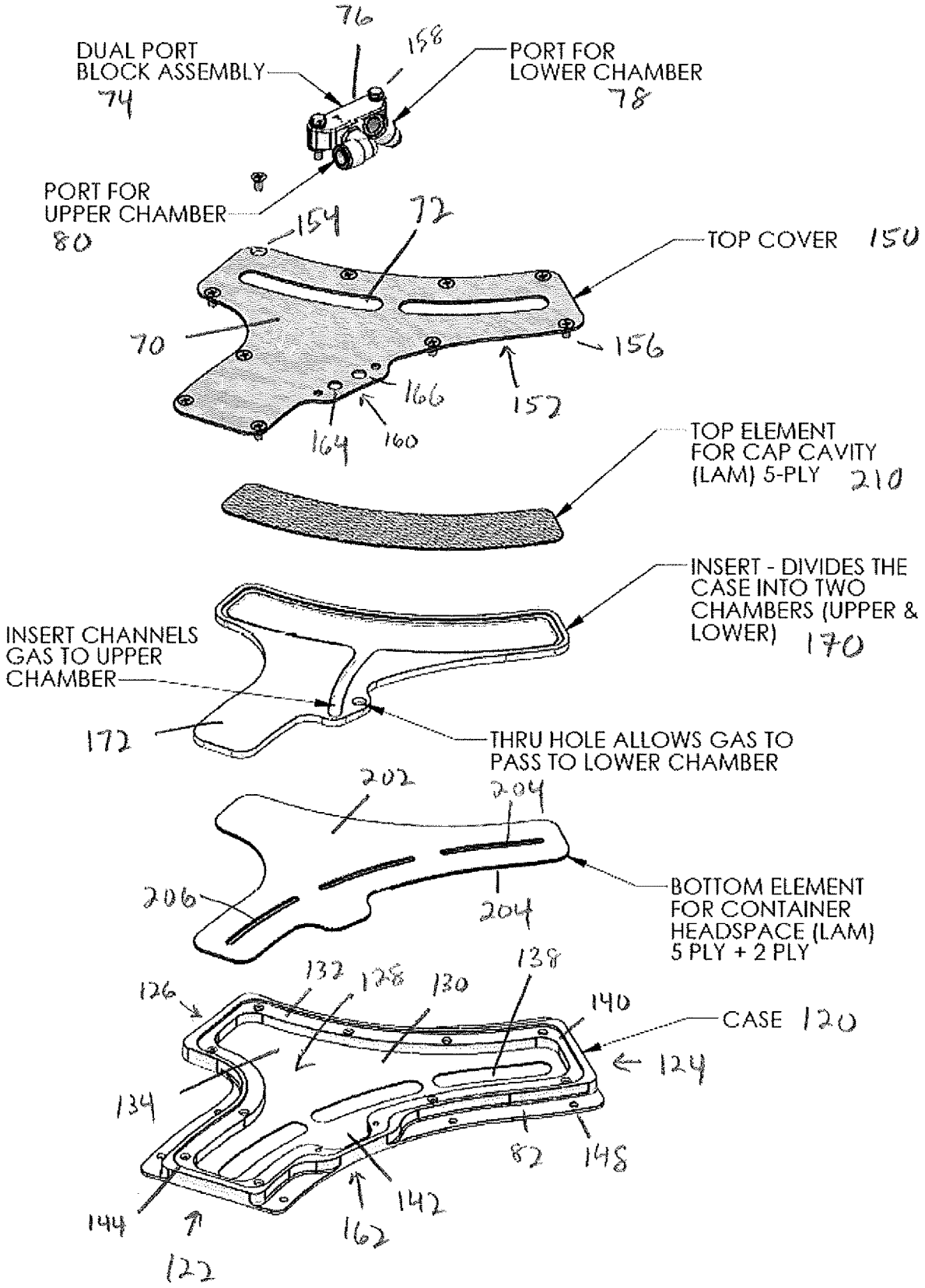
FIG. 7 is an exploded view of the capper gassing rail of FIG. 3.

FIG. 7 is an exploded view of the capper gassing rail 42 of FIG. 3. The capper gassing rail includes a lower case 120. The lower case has a plan shape which includes a container path having proximal and distal ends 122, 124, and a cap path having proximal and distal ends 126, 124, wherein the proximal ends of the container path and cap path are spaced apart, and the container path and cap path converge at the distal ends. The lower case includes a cavity 128 defined by a bottom wall 130 and a side wall 132, the bottom wall includes an upper interior surface 134, a lower surface 136, and a plurality of container gas distribution slots 138. The side wall includes a recessed seat 140 along the perimeter of the side wall. The side wall forms an extended portion 142 of the cavity. Threaded openings 144 are provided on the side wall, and through holes 148 are provided on the flange 82 defined by the bottom wall. The capper gassing rail includes a top cover 150 having the upper surface 70 and a bottom surface 152. The top cover includes a plurality of cap gas distribution slots 72 and a plurality of through holes 154 for receiving threaded fasteners 156 to secure the top cover to the lower case. The dual port block includes threaded fasteners 158 which are received by a pair of through holes 160 in the top cover and by a pair of threaded openings 162 on the lower case. A cap port opening 164 and a container port opening 166 are provided on the top cover.

FIGS. 7, 15A-15E show an insert 170 is provided between the lower case and the top cover. The insert includes an upper surface 172, a lower surface 174 and a side edge 176. An upper cavity 178 is formed in the upper surface and is defined in part by a cavity wall 182. The upper cavity generally extends along the cap path. A recessed seat extends along a portion of a perimeter of the upper cavity in the area of the cap path. The insert includes a tab portion 184. A groove 186 is formed in the upper surface and extends from the upper cavity to a location below and in fluid communication with the cap port opening of the top cover. A through hole 188 is at a location below and in fluid communication with the container port opening of the top cover. A lower cavity 190 is formed in the lower surface and is defined in part by a cavity wall 192. The lower cavity generally extends along the container path and tab portion. The through hole is shown to be located in the tab portion of the lower cavity.

A bottom gassing element 200 is provided and includes a plan shape similar to the insert. The bottom gassing element includes a top layer 202 and a bottom layer 204. The top layer is constructed of a 2-ply stainless steel mesh and includes a plurality of slots 206 aligned with the container gas distribution slots. The bottom layer is constructed of a 5-ply stainless steel mesh.

A top gassing element is provided and includes a plan shape similar to the upper cavity of the insert and extends generally along the cap path. The top gassing element is constructed of a 5-ply stainless steel mesh.

The bottom gassing element 210 is received in the cavity of the lower case in facing engagement with the upper interior surface. The insert is received in the recessed seat of the lower case with the lower surface of the insert in engagement with the bottom gassing element, and the cavity wall of the lower cavity in a spaced apart relationship with the bottom gassing element. The top gassing element is received in the upper cavity of the insert in a spaced apart relationship with the cavity wall of the upper cavity. The lower surface of the top cover is in engaging with the upper surface of the insert and the top gassing element. The threaded fasteners of the dual port block assembly extend through the through holes of the top cover and are threaded into the threaded openings of the lower case.

FIG. 8 is a plan view of the capper gassing rail of FIG. 7. The cap path is shown by the cap 220 shown at the proximal end of the cap path, the cap 222 shown at a mid-position of the capper gassing rail cap path, and the cap 224 shown at the distal end of the cap path.

FIG. 9 is a side view of the capper gassing rail of FIG. 3 and shows the low profile of the capper gassing rail. FIG. 10 is a bottom view of the capper gassing rail of FIG. 3 and shows the proximal end 122 of the container path and the distal end 124 of the container path.

Figure 13:
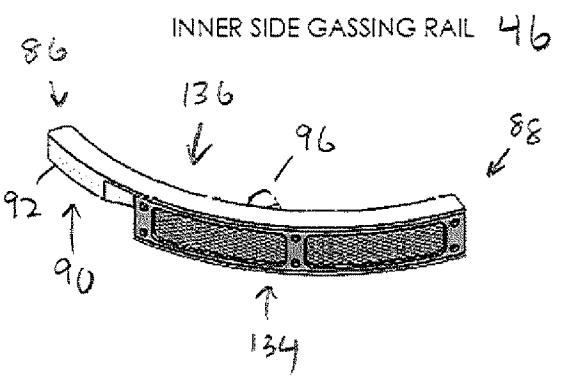
FIG. 13 is a perspective view of the inner side gassing rail of FIG. 3.
Figure 14:
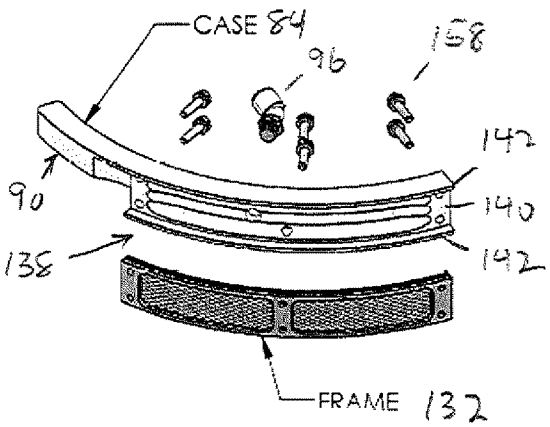
FIG. 14 is an exploded view of the inner side gassing rail of FIG. 13.
Figure 11:
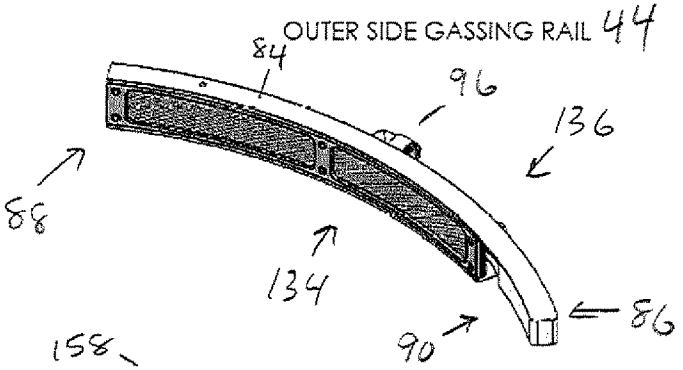
FIG. 11 is a perspective view of the outer side gassing rail of FIG. 3.
Figure 12:
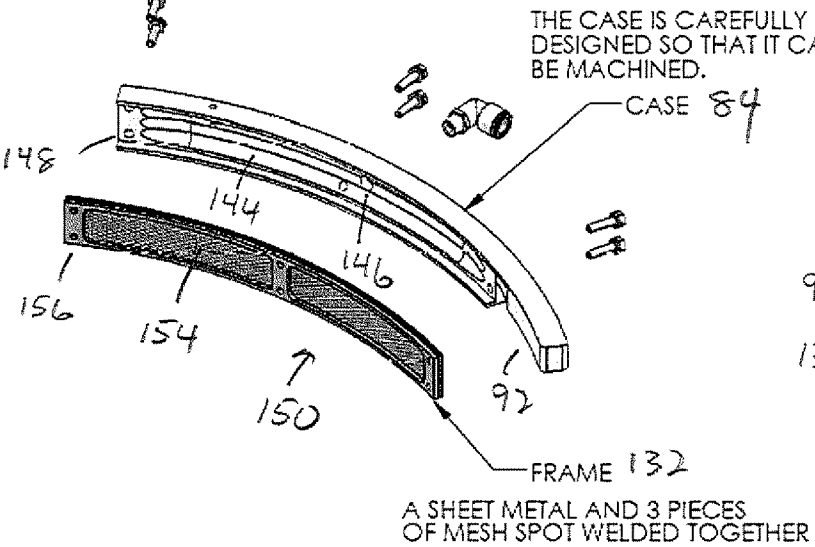
FIG. 12 is an exploded view of the outer side gassing rail of FIG. 11.
Figures 15A, 15B, 15C, 15D, 15E:
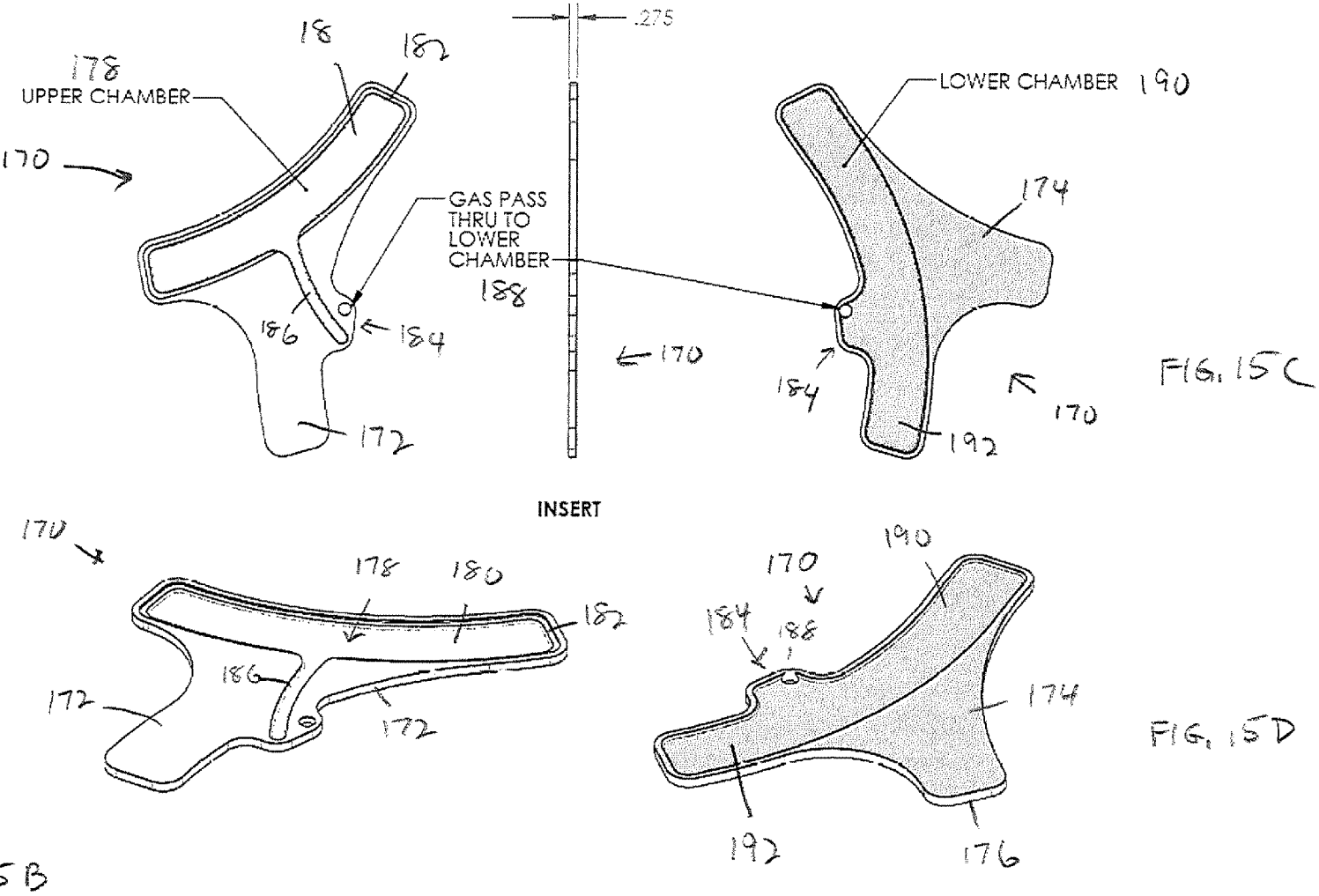
FIGS. 15A-E show various views of the insert shown in FIG. 7.

FIG. 11 is a perspective view of the outer side gassing rail 44 of FIG. 3. FIG. 12 is an exploded view of the outer side gassing rail of FIG. 11. FIG. 13 is a perspective view of the inner side gassing rail 46 of FIG. 3. FIG. 14 is an exploded view of the inner side gassing rail of FIG. 13. The side gassing rails include a curved case 84 and a curved frame 132. The case is machined from a single curved rectangular shaped component, which may be formed from metal. The case has an inboard and outboard side 134, 136. The inboard side is further machined to provide rectangular shaped recess 138 over a majority of its length extending form the distal end to nearly the proximal end, and forming recessed face 140 and two edges 142. Three parallel longitudinally extending grooves 144 are formed in the recessed face. A side rail port opening 146 extends through the rail from the outboard side to the grooves on the inboard side. A side rail port fitting 96 is coupled to the side rail port opening. Through holes 148 extend through the rail from the outboard side to the inboard side. A mesh baffle 150 is provided and includes a frame 132 and three layers of mesh 154 spot welded together. The frame includes threaded openings 156 to receive respective threaded fasteners 158.

A notch 90 is formed in the case at the proximal end to form a reduced profile proximal end, providing a mounting surface 92 where a threaded opening is formed for mounting to the curved transition bottom rail.

The outer side gassing rail is identical to the inner side gassing rail, with the exception that the inboard side of the outer side gassing rail is concave shaped and the inboard side of the inner side gassing rail is convex shaped.

Figure 16A:
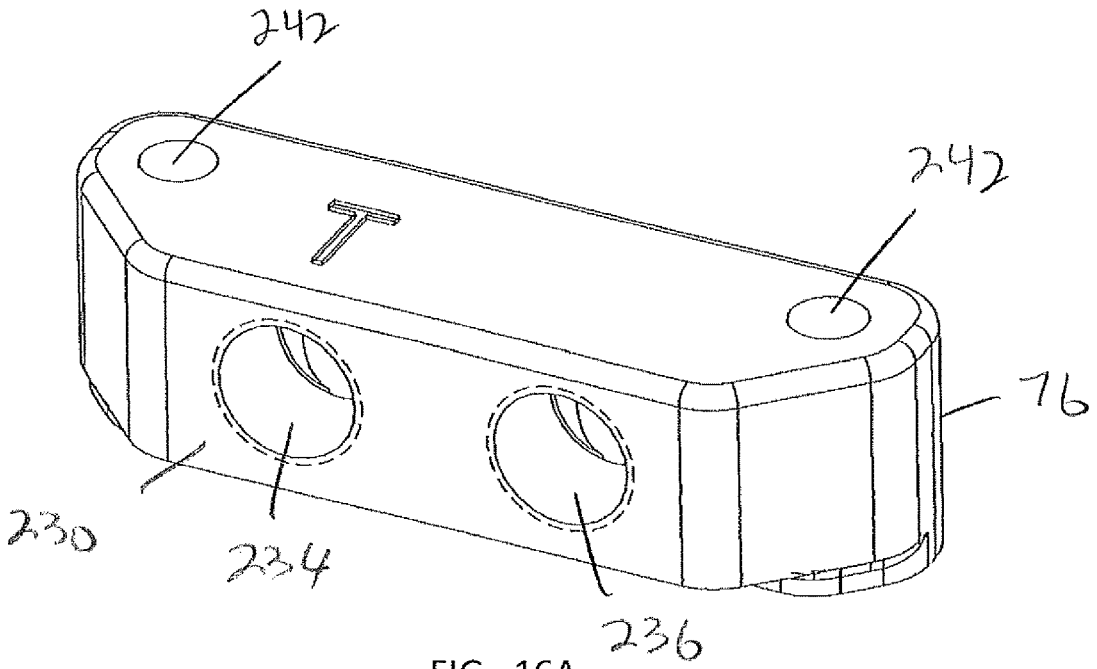
FIGS. 16A-C show various views of the dual port block of FIG. 7.
Figure 16B:
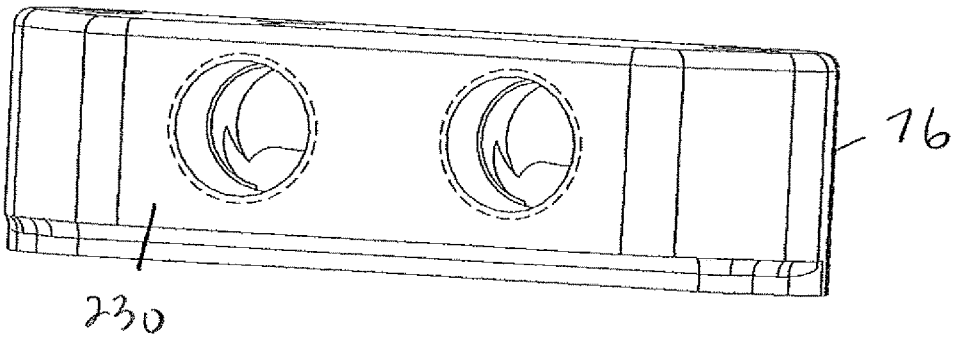
Figure 16C:
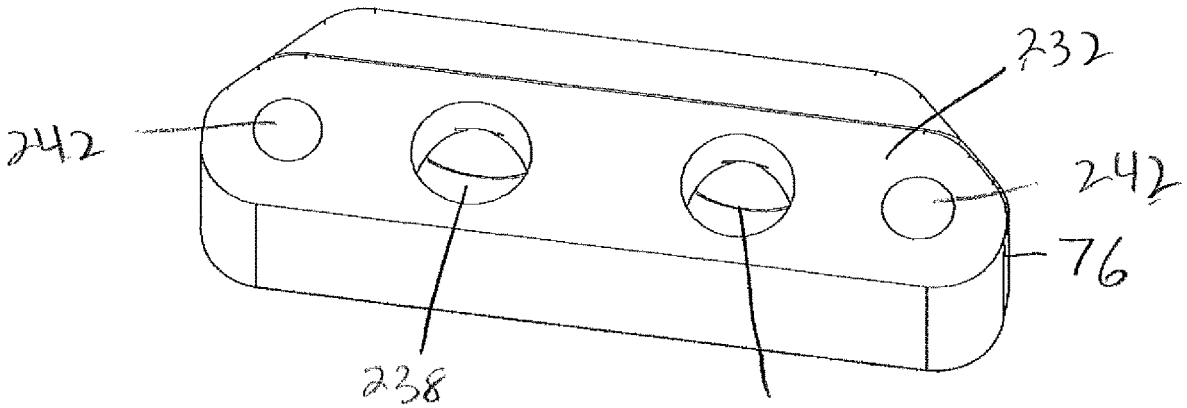

FIGS. 16A-C show various views of the dual port block 76 of FIG. 7. The dual port block includes a front side 230 and a mounting side 232. A cap block inlet 234 and a container block inlet 236 are located on the front side. A cap block outlet 238 and a container block outlet 240 are located on the mounting side. The cap block inlet is in fluid communication with the cap block outlet and the container block inlet is in fluid communication with the container block outlet. A cap port fitting is coupled to the cap block inlet and a container port fitting is coupled to the container block inlet. Through holes 242 are provided to receive fasteners 158 which extend through the top cover and into the threaded openings 162 of the lower case for mounting the dual port block to the capper gassing rail.

Figure 17:
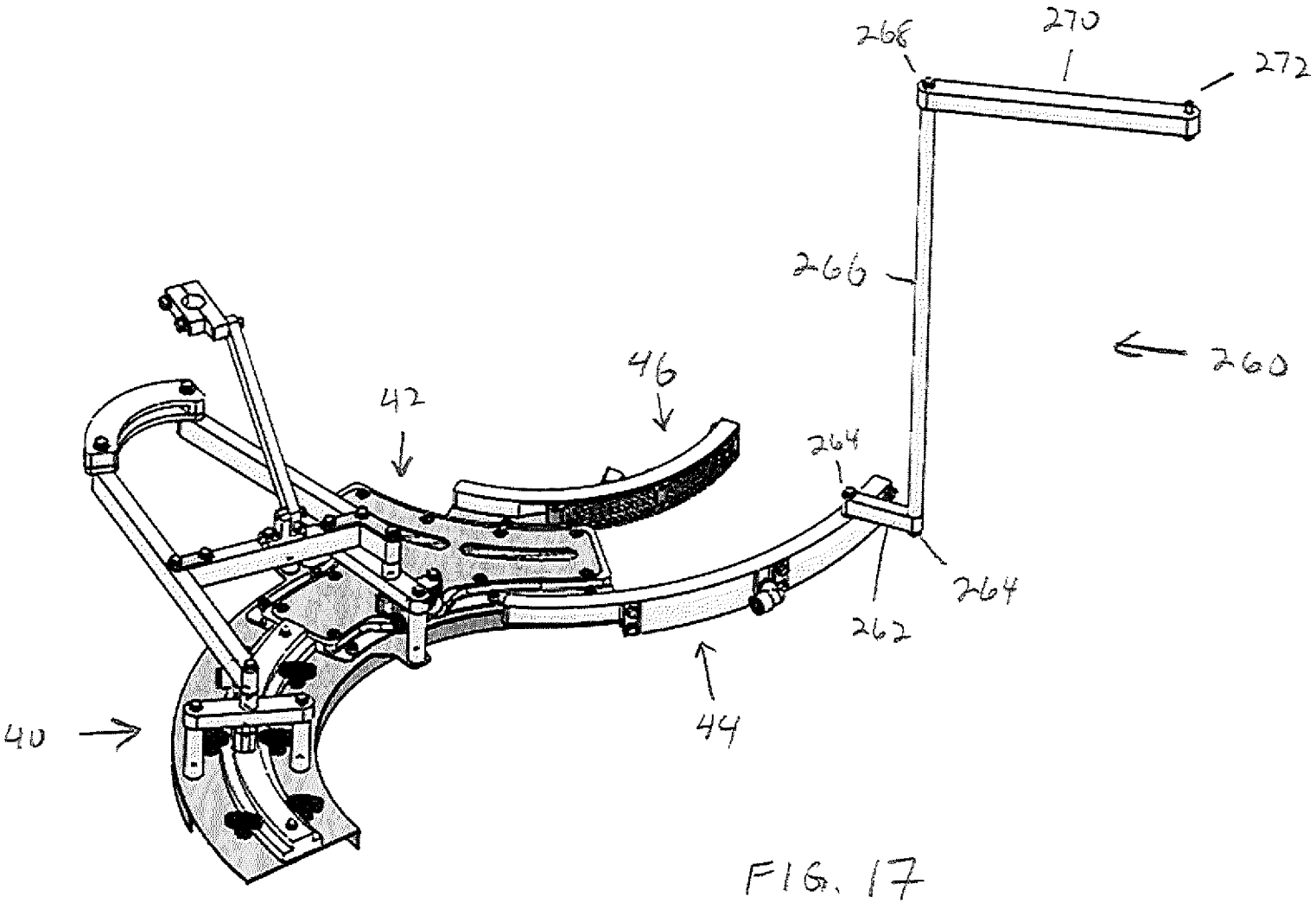
FIG. 17 is an elevated perspective view of the gassing rail system of FIG. 3 together with a support structure.

FIG. 17 is an elevated perspective view of the gassing rail system of FIG. 3 together with a support structure 260. The support structure includes a lower horizontal bar 262 including a fastener 264 at each end, wherein one end is attached to the outer side gassing rail. The other end is attached to a lower end of a vertical bar 266. The upper end of the vertical bar includes a fastener 268 for attachment to one end of an upper horizontal bar 270. The other end of the upper horizontal bar includes a fastener 272 for attachment to the center rotary structure of the rotary capping machine. In this manner, as the center rotary structure is initially adjust for the height of the next run of container, the gassing rail system of the present invention is simultaneously adjusted as well.

The invention claimed is:

1. A gassing rail for gas flushing containers and caps on a rotary capping machine, the gassing rail comprising:

a planar body;

an upper surface formed on the planar body, the upper surface having at least one cap gas distribution slot defining a longitudinally extending cap path, the cap gas distribution slot includes an infeed end and an exit end;

a lower surface formed on the planar body, the lower surface having at least one container gas distribution slot defining a longitudinally extending container path, the container gas distribution slot includes an infeed end and an exit end, wherein the cap infeed end is horizontally spaced apart from the container infeed end and the cap path and container path horizontally converge in the direction towards the cap exit end and container exit end.

2. The gassing rail of claim 1, wherein the cap gas distribution slot includes a plurality of slots and the container gas distribution slot includes a plurality of slots, and wherein the cap gas distribution and the container gas distribution slots are curved, and the planar body has an overall thickness of less than an inch.

3. The gassing rail of claim 1, wherein the planar body includes an upper chamber and a lower chamber, the upper chamber includes a top element and the lower chamber includes a bottom element, the planar body includes a cap port opening and a container port opening, the cap port opening is in fluid communication with the upper chamber and the container port opening is in fluid communication with the lower chamber and a cap port fitting is in fluid communication with the cap port opening, a container port fitting is in fluid communication with the container port opening, and the cap port and container port fittings extend horizontally from the planar body.

4. The gassing rail of claim 3, further comprising an insert received within the planar body, the insert is planar and includes an upper surface and a lower surface, the upper surface includes an upper cavity which extends along the cap path, the upper cavity defines a portion of the upper chamber, the upper chamber receives a top gassing element, the lower surface of the insert includes a lower cavity which extends along the container path, the lower cavity defines a portion of the lower chamber, the lower chamber receives a bottom gassing element, a cap fluid channel extends through the insert and is in fluid communication with the upper cavity and the cap port opening, a container fluid channel extends through the insert and is in fluid communication with the lower cavity and the container port opening.

5. The gassing rail of claim 4, wherein the cap fluid channel is a groove extending along the upper surface of the insert from the upper cavity to a location in the insert which is in fluid communication with the cap port opening, and the container fluid channel is a through-hole extending through the insert and orthogonal to a plane of the insert, the through-hole extending from the lower cavity to a location in the insert which is in fluid communication with the container port opening.

6. The gassing rail of claim 3, wherein the planar body includes:

a top cover, the top cover includes the at least one cap gas distribution slot defining a longitudinally extending cap path, a cap port opening, and a container port opening;

a lower case, the lower case includes a bottom wall, the bottom wall includes the at least one container gas distribution slot defining a longitudinally extending container path;

an insert received within the lower case, the insert is planar and includes an upper surface and a lower surface, the upper surface of the insert includes an upper cavity which extends along the cap path, the upper cavity defines a portion of the upper chamber, the upper cavity receives a top gassing element, the upper surface of the insert and the top gassing element present a flush surface for engagement with the top cover;

the lower surface of the insert includes a lower cavity which, in part, extends along the container path, the lower cavity defines a portion of the lower chamber, a bottom gassing element is located between and in contact with the lower surface of the insert and the bottom wall of the lower case, with the lower cavity of the insert and the bottom gassing element in a spaced apart facing relationship which defines a spaced apart area which extends along the container path; and a fluid channel extends from the upper cavity to a location below and fluidly aligned with the cap port opening in the top cover, the insert includes a through hole which is at a location below and fluidly aligned with the container port opening in the top cover, the through hole in the insert is in fluid communication with the lower cavity of the insert.

7. The gassing rail of claim 6, wherein a portion of the bottom element is aligned and in fluid communication with the through hole in the insert.

8. The gassing rail of claim 1, wherein the planar body includes a top cover; a lower case; and an insert received within the lower case; a top gassing element is located between the top cover and insert and the top gassing element is a 5-ply wire mesh; a bottom gassing element is located between the insert and the lower case and the bottom gassing element further comprises a 2-ply layer of stainless-steel mesh located below a 5-ply layer of stainless-steel mesh, the 5-ply layer of the bottom gassing element includes at least one slot aligned with the container gas distribution slot.

9. The gassing rail of claim 8, wherein the case includes a bottom wall having the lower surface, and an upper interior surface, a wall defining a perimeter wall of the lower chamber, and a recessed seat, wherein the recessed seat receives the top cover.

10. The gassing rail of claim 8, wherein the top cover includes the cap gas distribution slot and a cap port opening and a container port opening, the insert is planar and includes an upper surface and a lower surface, the upper surface includes an upper cavity which extends along the cap path and receives the top gassing element, a fluid channel extends from the upper cavity to a location below and fluidly aligned with the cap port opening in the top cover, the insert includes a through hole which is at a location below and fluidly aligned with the container port opening in the top cover, the lower surface of the insert includes a lower cavity which extends along the container path and receives the bottom gassing element, the through hole in the insert is in fluid communication with the lower cavity of the insert.

11. The gassing rail of claim 1, including a dual port block fastened to the upper or lower surface of the body, the dual port block having a side portion and a mounting side, a cap block inlet and a container block inlet are located on the side portion, a cap block outlet and a container block outlet are located on the mounting side, the cap block inlet is in fluid communication with the cap block outlet and the container block inlet is in fluid communication with the container block outlet, a cap port fitting is coupled to the cap block inlet and a container port fitting is coupled to the container block inlet.

12. A gassing rail system for gas flushing containers and caps on a rotary capping machine, the gassing rail system comprising;

a capper gassing rail having a planar body, an upper surface formed on the planar body, the upper surface having at least one cap gas distribution slot defining a longitudinally extending cap path, the cap gas distribution slot includes an infeed end and an exit end or downstream end, a lower surface formed on the planar body, the lower surface having at least one container gas distribution slot defining a longitudinally extending container path, the container gas distribution slot includes an infeed end and an exit end, wherein the cap infeed end is horizontally spaced apart from the container infeed end and the cap path and container path horizontally converge in the direction towards the cap exit end and container exit end; and at least one curved longitudinally extending side gassing rail having a proximal or infeed end and a distal or discharge end, the side gassing rail extends from the system away and downstream from the planar body, the side gassing rail further defines the longitudinally extending cap path, the side gassing rail defines an adjacent cap fastening area.

13. The gassing rail system of claim 12, further comprising a curved transition rail bottom, wherein the capper gassing rail is supported by the curved transition rail bottom and the at least one curved longitudinally extending side gassing rail is supported by the curved transition rail bottom.

14. The gassing rail system of claim 13, wherein the curved transition rail bottom includes an upper surface providing a mounting surface, the capper gassing rail is mounted to the upper surface at a distal end of the upper surface, and a rail top assembly is mounted to the upper surface at a location proximal to the capper gassing rail.

15. The gassing rail system of claim 12, wherein the rotary capping machine includes a center rotary structure adjustable for containers having different heights, the gassing rail system further comprising a mounting structure connected to the gassing rail system and having an attachment for mounting to the center rotary structure.

16. The gassing rail system of claim 12, further comprising a curved transition gassing rail assembly, the curved transition gassing rail assembly includes a curved transition rail bottom, the capper gassing rail is mounted to the curved transition rail bottom, the curved transition rail bottom includes at least one container gas distribution slot which is aligned with the respective at least one container gas distribution slot of the capper gassing rail.

17. The gassing rail system of claim 16, wherein the curved transition rail bottom includes a plurality of additional container gas distribution slots located proximal or prior to the at least one container gas distribution slots on the curved transition rail bottom, and at least one rail top assembly is secured to the curved transition rail bottom over the respective additional container gas distribution slots.

18. The gassing rail system of claim 16, wherein the curved transition rail bottom includes at least one flange extending laterally from the distal or discharge end, the at least one flange providing a mounting surface for a respective curved longitudinally extending side gassing rail.

19. The gassing rail system of claim 16, further comprising a straight gassing rail coupled proximal to the curved transition gassing rail assembly, the straight gassing rail adapted to purge the headspace of containers.

20. The gassing rail system of claim 12, wherein each of the at least one curved longitudinally extending side gassing rail includes a case, the case includes a proximal extending flange having a horizontal surface for mounting to the curved transition rail bottom.

21. The gassing rail system of claim 12, wherein each of the at least one curved longitudinally extending side gassing rail includes a case and a mesh baffle, each case is machined and includes at least one longitudinally extending gas groove on a container facing side, and a case through hole providing fluid communication between the at least one longitudinally extending gas groove to a case side opposite from the container facing side, the case through hole coupled to a port fitting.

22. The gassing rail system of claim 21, wherein each mesh baffle includes a frame and a plurality of mesh layers.

23. The gassing rail system of claim 21, wherein each case includes a notch at the proximal end forming a horizontal surface for mounting to the gassing rail system.

24. The gassing rail system of claim 12, wherein the at least one curved longitudinally extending side gassing rail includes two curved longitudinally extending side gassing rails, the two side gassing rails face one another in a spaced apart relationship defining the cap fastening area.

* * * * *